United States Patent [19]

Thornton, Jr. et al.

[11] 4,360,758

[45] Nov. 23, 1982

[54] HIGH-INTENSITY-DISCHARGE LAMP OF THE MERCURY-METAL HALIDE TYPE WHICH EFFICIENTLY ILLUMINATES OBJECTS WITH EXCELLENT COLOR APPEARANCE

[75] Inventors: William A. Thornton, Jr., Cranford; Daniel A. Larson, Cedar Groove; Edward Chen, Glen Rock, all of N.J.

[73] Assignee: Westinghouse Electric Corp., Pittsburgh, Pa.

[21] Appl. No.: 228,039

[22] Filed: Jan. 23, 1981

[51] Int. Cl.[3] ..... H01J 61/18; H01J 61/48

[52] U.S. Cl. ..... 313/227

[58] Field of Search ..... 313/229

[56] References Cited

U.S. PATENT DOCUMENTS

| | | | |
|---|---|---|---|
| 3,234,421 | 2/1966 | Reiling | 313/25 |
| 3,407,327 | 10/1968 | Houry et al. | 313/229 |
| 3,521,110 | 7/1970 | Johnson | 313/227 |
| 3,781,586 | 12/1973 | Johnson | 313/174 |
| 3,875,453 | 4/1975 | Thornton | 313/487 |
| 3,882,345 | 5/1975 | Kazek et al. | 313/229 |
| 4,027,190 | 5/1977 | Shintani et al. | 313/229 |
| 4,176,299 | 11/1979 | Thornton | 315/326 |

OTHER PUBLICATIONS

Lorenz, "Improvement of metal halide lamps by complex formation"; vol. 8, No. 3, 1976; pp. 136–140.

Ishigami et al., "A metal halide lamp with ultra-high-color rendering property", J. Light and Vis. Env. vol. 1, #2, 1977; pp. 5–9.

*Primary Examiner*—Robert Segal

*Attorney, Agent, or Firm*—W. D. Palmer

[57] ABSTRACT

High-intensity-discharge lamp of the mercury-metal halide type efficiently illuminates objects with excellent color appearance. The arc tube filling comprises the usual inert, ionizable starting gas and mercury in predetermined amount as required to provide a predetermined operating voltage drop between the lamp electrodes. The metal halide filling substantially comprises a predetermined limited amount of thallous iodide, a predetermined limited amount of stannous iodide and a predetermined limited amount of calcium iodide. The stannous iodide is used in such amount that it serves primarily to enhance the emission of the calcium iodiode and the amount of stannous iodide is sufficiently limited to curtail the generation of the characteristic continuous tin emission. The calcium iodide is present in greater gram amount than the tin iodide so that the effects of the calcium iodide emission are predominant. The resulting discharge has its emission concentrated in three selected wavelength portions of the visible spectrum, namely, blue violet which is due primarily to the calcium iodide emission, green which is due to the thallium iodide emission, and red which is due to the tin-iodide-enhanced calcium iodide emission. The efficiency of the composite discharge is good and the color appearance of illuminated objects is excellent.

6 Claims, 5 Drawing Figures

HIGH-INTENSITY-DISCHARGE LAMP OF THE MERCURY-METAL HALIDE TYPE WHICH EFFICIENTLY ILLUMINATES OBJECTS WITH EXCELLENT COLOR APPEARANCE

BACKGROUND OF THE INVENTION

This invention relates to high-intensity-discharge (HID) lamps and, more particularly, to HID lamps of the mercury-metal halide type which efficiently illuminate objects with an excellent color appearance.

Mercury-metal halide HID lamps are described in U.S. Pat. No. 3,234,421 dated Feb. 8, 1966 to Reiling. Such lamps incorporate selected metal halide as a part of the discharge-sustaining constituents and these halides can be varied to vary the emission spectrum of the lamp. The mercury is present in a predetermined amount as required to provide a predetermined voltage drop between the lamp electrodes when the lamp is normally operating and the mercury also contributes some selected visible emissions to the composite light output of the lamp. Possible metal halides which can be used are specified in this patent as iodides of lithium, sodium, cesium, calcium, cadmium, barium, mercury, gallium, indium, thallium, germanium, tin thorium selenium, tellurium and zinc.

In U.S. Pat. No. 3,407,327 dated Oct. 22, 1968 to Koury et al., is disclosed a mercury-metal halide HID lamp which incorporates sodium iodide and scandium iodide as the principal discharge-sustaining and light-emitting constituents. Commercial embodiments of such lamps are used extensively in stadium lighting and area lighting as well as some interior-type applications. The combined sodium and scandium discharge together with the mercury generates what can be described as forest of lines of visible emission which attempts to duplicate the effect of a continuous spectrum. Such lamps are noticeably deficient in the red region of the spectrum, however, which impairs the color appearance of objects which are illuminated by these lamps.

In U.S. Pat. No. 3,521,110 dated July 21, 1970 to Johnson is disclosed a mercury-metal halide type lamp wherein one or more of a large group of specified halides have added thereto selected halides of tin, lead, antimony or bismuth in order to provide what is termed a regenerative halide cycle, with stannous halide being preferred. U.S. Pat. No. 3,781,586 dated Dec. 25, 1973 to Johnson discloses adding elemental tin to the discharge-sustaining filling in order to prevent the existence of free iodine. A discharge-sustaining filling including both stannous chloride and stannous iodide together with sodium halide is disclosed in U.S. Pat. No. 3,882,345 dated May 6, 1975 to Kazek et al. Such a lamp displays a continuous spectrum of the tin discharge with broadened sodium line radiations superimposed thereon. Lighting Research and Technology, Volume VIII, No. 3 (1976), pages 136–140, article by Lorenz, discloses that red emission can be obtained when calcium iodide is included in a mercury-metal halide lamp. To enhance the emission properties of the calcium iodide, aluminum chloride is included therewith.

In Journal Light & Vis. Env., Volume 1, No. 2 (1977), pages 5–19, article by Ishigami et al., is disclosed a mercury-metal halide lamp wherein the red emission of a tin-halide continuous spectrum is augmented by the molecular emission of calcium halide. The predominate material which contributes to the light emission from the discharge remains the tin halide, however, and the additive calcium halide enhances the color rendering properties of the lamp by adding some needed red emissions. A U.S. Pat. No. which corresponds to this publication is 4,027,190, dated May 31, 1977, wherein the continuous tin spectrum is augmented in the red regions of the spectrum by a small calcium halide emission superimposed thereon. In the foregoing art, the tin-halide discharge is shown as predominating the lamp emission characteristics, with the calcium halide only used as an additive to improve the coloring rendering properties of the composite lamp emission.

Summarizing the development of the mercury-metal halide lamps to date, it is probably safe to say that every metal which will form a vaporizable halide has been tried as a discharge-sustaining constituent, along with numerous combinations of metal halides. The majority of these efforts have been directed toward producing a composite discharge which resembles a continuous spectrum, in order to simulate the illumination of natural light as closely as possible.

In U.S. Pat. No. 4,176,299, dated Nov. 27, 1979 to W. A. Thornton, one of the present applicants, is disclosed a light source which generates three narrow bands or lines of selected radiations, namely, blue-violet radiations peaked at about 450 mm, green radiations peaked at about 540 nm and a red-orange radiations peaked at about 610 nm. When these individual bands or lines of radiations are blended, the color appearance of illuminated objects is excellent. In U.S. Pat. No. 3,875,453 dated Apr. 1, 1975 is disclosed a fluorescent lamp having high color-discrimination capability. This is achieved by concentrating the emissions in the wavelength ranges of 400–470 nm, 500–550 nm and 610–680 nm with the relative proportions of the emissions selected to produce visible light of predetermined ICI coordinates.

In recent years, a color-preference index has been proposed for rating the performance of light sources in accordance with what the normal observer considers to be the preferred coloration for familiar objects. This color preference index (CPI) is summarized in the Journal of the Illuminating Engineering Society, pages 48–52, October 1974, article entitled "A Validation of the Color-Preference Index" by W. A. Thornton, one of the present applicants.

SUMMARY OF THE INVENTION

There is provided a mercury-metal halide HID lamp which efficiently illuminates objects with excellent color appearance. The lamp basically comprises a sealed light-transmitting arc tube of predetermined dimensions and enclosing a predetermined volume. Electrodes are operatively disposed within the arc tube and spaced from one another a predetermined distance to define therebetween an arc path of predetermined length. Lead-in conductors are sealed through the arc tube and electrically connected to the electrodes. A light-transmitting protective envelope surrounds the arc tube and encloses a predetermined environment. Conductor means are sealed through the protective envelope and means are provided to electrically connect the conductor means to the lead-in conductors which connect to the electrodes. The foregoing construction is generally conventional. In accordance with the present invention, the arc tube encloses a small charge of inert, ionizable starting gas and a discharge-sustaining filling which substantially comprises: Mercury is present in predetermined amount as required to provide a predetermined voltage drop between the lamp electrodes when the lamp is normally operating. In this respect the present lamp is similar to other mercury-halide lamps. Thallium iodide (T1I) is present in limited amount to provide from about 0.02 mg to about 0.2 mg of T1I per cc of volume enclosed by the arc tube. Stannous iodide is present in amount to provide from about 0.1 mg to about 0.8 mg of $SnI_2$ per cc of volume enclosed by the arc tube. Calcium iodide is present in amount to provide from about 0.25 mg to about 2.5 mg of $CaI_2$ per cc of volume enclosed by the arc tube, and the calcium iodide is also present in amount to provide from about 1.2 mg to about 10 mg of $CaI_2$ per meg of the stannous iodide which is present. The lamp is intended for normal operation with a predetermined power consumption, and means associated with the lamp cause the cold-spot temperature within the arc tube during normal operation to be at least about 750° C., in order to insure that the discharge-sustaining constituents are adequately vaporized.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENTS

Figure 1:
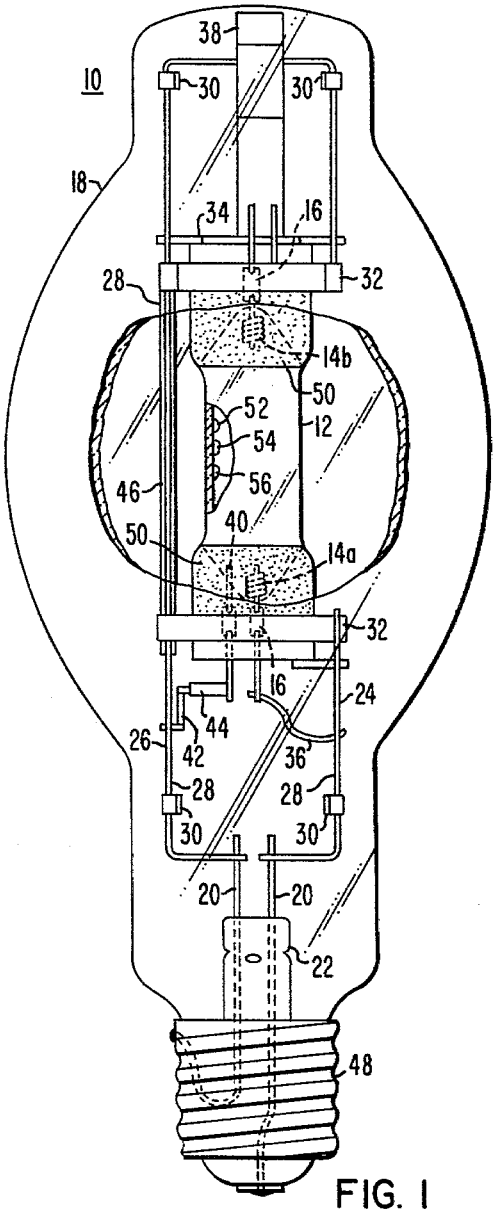
FIG. 1 is an elevational view shown partly in section, of a complete mercury-metal halide HID lamp which is fabricated in accordance with the present invention.

With specific reference to the form of the invention which is illustrated in the drawings, the HID lamp 10 which is shown in FIG. 1 is designed to efficiently illuminate objects with an excellent color appearance as will be hereinafter described. The lamp comprises a sealed, light-transmitting arc tube 12 fabricated of quartz having predetermined dimensions and enclosing a predetermined volume. Electrodes 14*a*, 14*b* are operatively disposed within the arc tube and spaced from one another a predetermined distance to define therebetween an arc path of predetermined length. Lead-in conductors 16 are sealed through the arc tube with molybdenum ribbon seals and electrically connect to the electrodes 14*a*, 14*b*. A light-transmitting protective envelope 18, which can be fabricated of hard glass or quartz, surrounds the arc tube 12 and encloses a predetermined environment such as 300 torrs of nitrogen. Conductor means 20 are sealed via a conventional stem press 22 through the protective envelope 18 and the conductor means 20 are electrically connected through additional conductors 24, 26 to the lead-in conductors 16 and electrodes 14*a*, 14*b*.

Considering the lamp 10 more specifically, the arc tube 12 is designed to be operated with a power input of 400 watts, the electrodes 14*a*, 14*b* are spaced from one another by approximately 4.4 cm, and the normal operating voltage drop between the electrodes is 135 volts. The arc tube 12 is supported within the protective envelope 18 by means of a supporting frame 28 which also provides current supply to one of the electrodes. The supporting frame 28 is held in position at its upper end by leaf spring supports 30 and similar supports are provided proximate the neck portion of the envelope. Metal strapping 32 which connects to the frame supports the upper and lower ends of the arc tube 12. Electrical connection to the upper electrode 14*b* is completed through conductor member 34 and electrical connection to the lower electrode is made through a flexible conductor 36. A getter member 38 is provided proximate the dome portion of the envelope 18 and this getter is a nickel-coated iron strip which has affixed thereto a powdered getter alloy of aluminum and zirconium in the weight ratio of 16:84. Such getters are well known and are marketed under the designation S.A.E.S. getters by the company of the same name of Milan, Italy. A starting electrode 40 is positioned at one end of the arc tube and electrically connects to the oppositely disposed main electrode 14*b* through a starting resistor 42. Once the lamp operation is initiated, a thermal switch 44 removes the starting electrode from circuit. A glass sleeve 46 is provided about the lead conductor-frame member 28 proximate the arc tube 12 to limit the effects of electric fields. The lamp is provided with the usual mogul-type base 48. The ends of the arc tube 12 are coated with a suitable heat reflecting coating 50 such as a coating of zirconium oxide powder, in order to increase the vapor pressure of the arc tube fill constituents.

The total amounts of the discharge-sustaining constituents which are included in the arc tube 12 will be dependent upon the lamp wattage rating and three different lamp sizes will be considered. A lamp normally intended to be operated at 175 watts incorporates an arc tube which encloses a volume of 3.6 cc, an electrode spacing of 2.7 cm and a normal operating voltage drop of 130 volts. A 250-watt-size lamp utilizes an arc tube which encloses a volume of 5.4 cc, an electrode spacing of 3.6 cm, and a normal operating voltage drop of 130 volts. A 400-watt-size lamp incorporates an arc tube which encloses a volume of 11.5 cc. These arc tube sizes and operating parameters can vary somewhat. The arc tube is filled with a small charge of inert, ionizable, starting gas such as 28 torrs of argon, for example, and mercury 52 is included in the arc tube in predetermined amount as required to provide the predetermined voltage drop between the electrodes when the lamp is normally operating. Both the starting gas and mercury dosing are generally conventional as far as lamp design is concerned.

In accordance with the present invention, a specific three-component mixture of discharge-sustaining iodides is utilized as the principal discharge-sustaining filling. These three components interact in such manner so that when their emissions are combined with the mercury emissions, the composite discharge constitutes a gapped type of highly discontinuous emission which is concentrated in three separate discrete regions of the visible spectrum, namely, the blue-violet region, the green region, and the red region. When these separate and discrete emissions are combined, the overall color appearance of illuminated objects is excellent and the efficiency of the discharge, as measured in terms of lumens, is also very good.

In accordance with the present invention, calcium iodide 54 and tin iodide 56 are used in such relative amounts that the tin iodide enhances the red calcium emission without contributing an appreciable amount of the continuous tin emission spectrum. By way of further explanation, tin iodide or tin halide when present in appreciable amounts as a discharge-sustaining constituent will contribute a tin diode or halide emission spectrum which can be described as continuous over most or all of the visible spectrum. It has been proposed, as discussed in the background section, to augment this continuous tin emission spectrum with a little red calcium emission so that the calcium emission is superimposed as a minor constituent onto the predominant continuous tin spectrum.

In accordance with the present invention, in contrast to these prior practices, the amount of tin is limited so that the red calcium emission is enhanced without introducing in effective amounts the continuous tin emission spectrum. Thallous iodide is utilized to provide a green emission and since this halide is nearly all vaporized, the amount of thallous iodide (TlI) which is added to the arc tube is quite limited. In accordance with the present invention, thallium iodide is present in amount to provide from about 0.02 mg to about 0.2 mg of TlI per cc of volume enclosed by the arc tube. Stannous iodide is present in amount to provide from about 0.1 mg to about 0.8 mg of $SnI_2$ per cc of volume enclosed by the arc tube. Calcium iodide is present in amount to provide from about 0.25 mg to about 1.5 mg of $CaI_2$ per cc of volume enclosed by the arc tube and also to provide from about 1.2 mg to about 10 mg of $CaI_2$ per mg of the stannous iodide present. The lamp when normally operated is intended to have a predetermined power consumption and means associated with the lamp cause the cold spot temperature within the arc tube during normal lamp operation to be at least about 750° C. This cold spot temperature is normally controlled by the heat-conserving coatings 50 and the power at which the lamp is operated. Other techniques can be utilized to control the cold-spot temperature, such as by providing extra insulation over the ends of the arc tube, if this is desired.

In the following Table I is described a series of different lamps wherein arc tubes designated (1) and (2) were 175-watt-size,, arc tube (3) was a 250-watt-size and the remainder were 400-watt-size arc tubes. Opposite each arc tube designation is the filling in milligrams which was dosed into the arc tubes along with an indication of the resulting color temperature (CT), the lumens per watt (LPW), and the color preference index (CPI), along with the watts input divided by the rated watts at which such arc tubes are normally operated. In other words, in tube (4), the arc tube was operated at two different wattages, namely, 400 watts and 400×1.5 or 600 watts. This affects the color temperature and in some cases the lumens per watt and the color preference index, since the vapor pressures of the discharge-sustaining constituents will vary with the operating wattage.

In arc tube No. 14 is identical to arc tube No. 5 except that tin iodide was not included. The color temperature, the lumens per watt and the color preference index are all deleteriously affected.

TABLE I

| Arc Tube No. | mg Hg | mg $HgI_2$ | mg TlI | mg $CaI_2$ | mg $SnI_2$ | mg In | CT | LPW | CPI | Watts Input / Rated Watts |
|---|---|---|---|---|---|---|---|---|---|---|
| 1 | 35 | 1 | 0.2 | 4.2 | 2.6 | | 3590 | 67 | 121 | 1.7 |
| | | | | | | | 4500 | 60 | 108 | 1 |
| 2 | 35 | 1 | 0.2 | 1.4 | 1.0 | | | 85 | 109 | 2.2 |
| 3 | 35 | 1 | 0.4 | 5.2 | 2.5 | | 4220 | 81 | 117 | 1.6 |
| 4 | 60 | 3 | 0.6 | 12 | 5 | | 3550 | 60 | 122 | 1 |
| | | | | | | | 2750 | 57 | 121 | 1.5 |
| 5 | 50 | | 1.2 | 12 | 4 | | 3390 | 77 | 120 | 1.5 |
| 6 | 50 | | 1.2 | 20 | 6 | | 3300 | 64 | 122 | 1.5 |
| | | | | | | | 4520 | 60 | 100 | 1 |
| 7 | 50 | | 1.2 | 16 | 5 | | 3640 | 77 | 120 | 1.5 |
| 8 | 50 | | 1.2 | 20 | 6 | | 3790 | 75 | 118 | 1.5 |
| 9 | 40 | | 0.6 | 12 | 7.5 | | 3216 | 55 | 121 | 1 |
| 10 | 60 | 3 | 1.0 | 8 | 5 | | 3660 | 69 | 122 | 1.5 |
| | | | | | | | 4330 | 66 | 103 | 1 |
| 11 | 60 | 3 | 0.6 | 4 | 2.5 | | 4420 | 72 | 110 | 1.5 |
| 12 | 60 | | 1.2 | 16 | 2.5 | | 4400 | 75 | 110 | 1.5 |
| 13 | 60 | 3 | 0.4 | 4 | 2.5 | 0.2 | 4664 | 60 | 113 | 1.5 |
| 14 | 50 | | 1.2 | 12 | | | 5300 | 62 | 87 | 1.5 |

In the following Table II are listed the individual dosing or fill-constituent parameters for the arc tubes as set forth in Table I. This includes the milligrams of thallous iodide per cc of arc tube volume, the milligrams of stannous iodide per cc of arc tube volume, the milligrams of calcium iodide per cc of arc tube volume and the milligrams of calcium iodide divided by the milligrams of tin iodide for each of the arc tubes as listed under Table I.

TABLE II

| Arc Tube No. | mg TlI/cc of arc tube | mg $SnI_2$/cc of arc tube | mg $CaI_2$/cc of arc tube | mg $CaI_2$ / mg $SnI_2$ |
|---|---|---|---|---|
| 1 | 0.056 | 0.72 | 1.17 | 1.6 |
| 2 | 0.056 | 0.28 | 0.39 | 1.4 |
| 3 | 0.074 | 0.46 | 0.96 | 2.1 |
| 4 | 0.052 | 0.44 | 1.04 | 2.4 |
| 5 | 0.104 | 0.35 | 1.04 | 3.0 |
| 6 | 0.104 | 0.52 | 1.74 | 3.3 |
| 7 | 0.104 | 0.44 | 1.39 | 3.2 |
| 8 | 0.104 | 0.52 | 1.74 | 3.3 |
| 9 | 0.052 | 0.65 | 1.04 | 1.6 |
| 10 | 0.086 | 0.44 | 0.7 | 1.6 |
| 11 | 0.052 | 0.22 | 0.35 | 1.6 |
| 12 | 0.104 | 0.22 | 1.39 | 6.4 |
| 13 | 0.035 | 0.22 | 0.35 | 1.6 |
| 14 | 0.052 | — | 1.04 | — |

While indium has been included in small amounts in the arc tube designated 13, in order to supply additional blue-violet radiations, this is not necessary since blue-violet emission is supplied by the calcium iodide. The thallium iodide supplies most of the green emission and the calcium iodide the red emission. While a limited quantity of tin iodide enhances the red calcium emission, if an appreciable amount of the tin continuous spectrum is present, it rapidly suppresses the green thallium emission, the blue-violet emission which is primarily due to calcium, and the ultraviolet emission. Omitting the calcium iodide reduces the lumens per watt as well as drastically impairing the color and the color rendering qualities of the lamp. Omitting the tin iodide affects the contributions of the other constituents, and thereby reduces the lumens per watt, the calcium red emission, substantially decreases the color preference index, and raises the color temperature of the lamp. Minor tin iodide emissions which may be present are not significant to the performance of the lamp.

Figure 2:
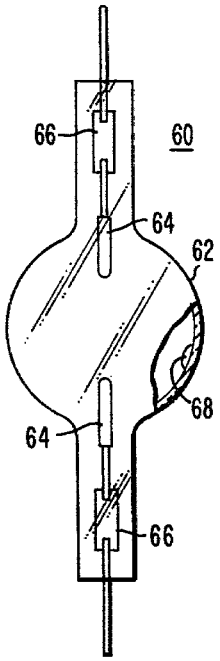
FIG. 2 represents an arc tube of a miniature mercury-metal halide HID lamp which is provided with a discharge-sustaining filling in accordance with the present invention.

In U.S. Pat. No. 4,170,747 dated Oct. 9, 1979 to Davenport is described a miniature mercury-metal halide lamp. The presennt discharge-sustaining filling can also be used in such miniature-type lamps to provide an excellent color appearance of illuminated objects. Such a lamp is shown in diagrammatic form in FIG. 2. Briefly, the lamp 60 comprises a miniature quartz envelope 62 having electrodes 64 operatively spaced therein and connected to seals 66 which extend through the envelope. The lamp contains a discharge-sustaining filling 68 which is proportioned in accordance with the present invention.

Figure 3:
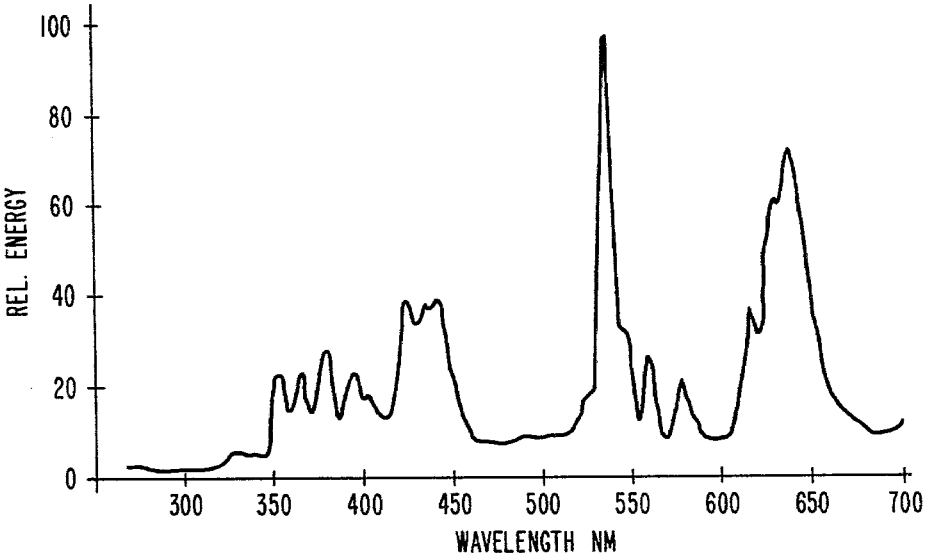
FIG. 3 sets forth the spectral power distribution for a specific mercury-metal halide lamp fabricated in accordance with the present invention.

In FIGS. 3 is plotted the spectral power distribution for a lamp incorporating the arc tube designated (11) in Table I and Table II. As shown in FIG. 3, the discharge is concentrated primarily in three relatively narrow discrete regions of the visible spectrum, namely, the blue-violet, the green and the red.

Figure 4:
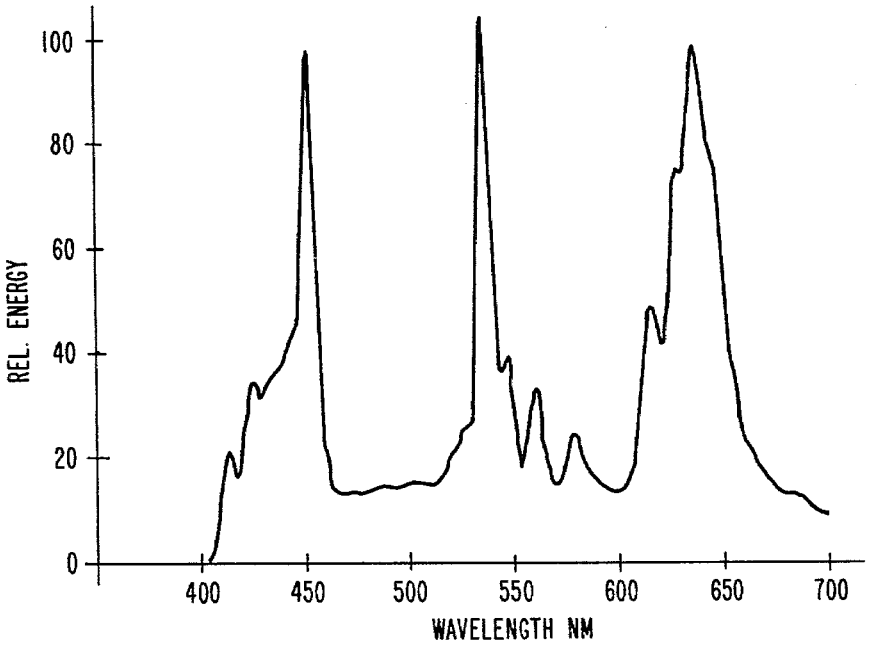
FIG. 4 is the spectral power distribution for a modified mercury-metal halide lamp fabricated in accordance with the present invention.

In FIG. 4 is shown the spectral power distribution for a lamp incorporating the arc tube designated (13) in Table I and Table II wherein a very small amount of indium is also included in the arc tube, in order to enhance the blue-violet emission. As shown in FIG. 4, the emission spectrum is concentrated primarily in the blue-violet, the green and the red regions of the visible spectrum.

Figure 5:
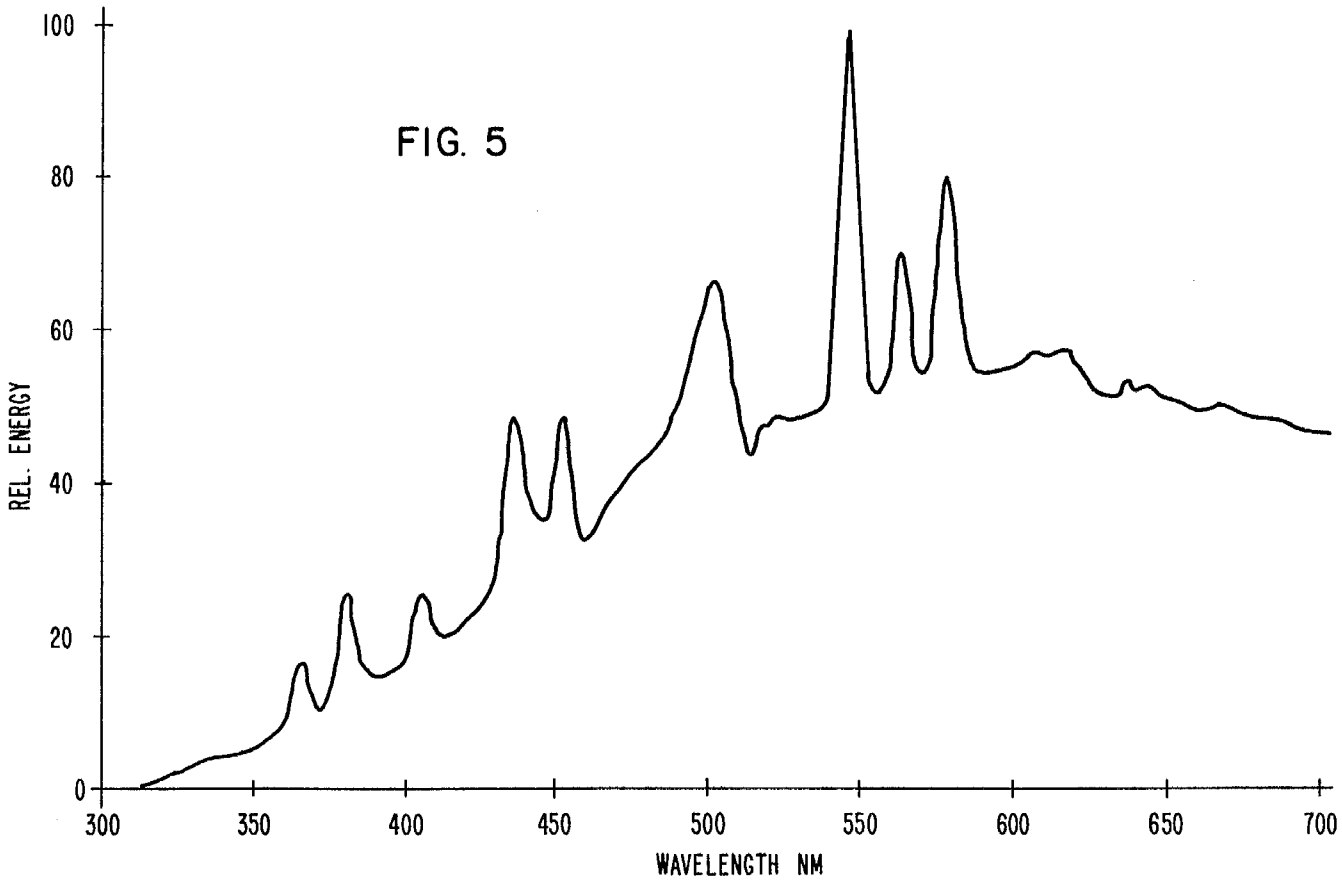
FIG. 5 is the spectral power distribution for a mercury-metal halide lamp in which tin is the predominant emitter.

For purposes of comparison, in FIG. 5 is shown the spectral power distribution for a mercury-metal halide lamp in which tin provides the predominant emission. As shown, the spectrum is strong and continuous throughout the visible region.

In the arc tubes designated (1), (2), (3), (4), (10), (11) and (13) in Table I, a small amount of additional iodide is introduced into the arc tubes as mercury iodide. The metallic discharge-sustaining constituents, other than mercury, and the halogen need not be present in the arc tube in exact stoichiometric proportions.

While the broad ranges for thallous iodide, calcium iodide and tin iodide have been specified hereinbefore, for most arc tubes the best performance is obtained when the thallous iodide is present in such amount as to provide from 0.04 mg to 0.14 mg of TlI per cc of volume enclosed by the arc tube, stannous iodide is present in amount to provide from 0.2 mg to 0.6 mg of $SnI_2$ per cc of volume enclosed by the arc tube, and calcium iodide is present in amount to provide from 0.3 mg to 2.0 mg of $CaI_2$ per cc of volume enclosed by the arc tube and to provide from 1.4 mg to 8 mg of $CaI_2$ per mg of the stannous iodide.

Various other metal iodide additives have been used in place of the tin iodide, in order to enhance the calcium iodide emission. The results have varied somewhat, but none of these other additive materials are as effective as the tin iodide. Results are summarized in the following Table III and all reported results are for an arc tube of 400-watt size.

TABLE III

| Arc Tube No. | mg Hg | mg $HgI_2$ | mg TlI | mg $CaI_2$ | mg (specified iodide) | CT | LPW | CPI | Watts Input / Rated Watts |
|---|---|---|---|---|---|---|---|---|---|
| 15 | 60 | 7.5 | 0.4 | 4 | (3.0 Bismuth iodide) | 3600 | 53 | 109 | 1.5 |
| 16 | 50 | 3.0 | 1.2 | 12 | (2.9 Chromium iodide) | 3800 | 48 | 114 | 1.5 |
| 17 | 50 | 3.0 | 0.9 | 12 | (0.5 Titanium iodide) | 6000 | 59 | 120 | 1.5 |
| 18 | 50 | | 1.2 | 12 | (6.0 Gallium iodide) | 5500 | 50 | 115 | 1.25 |
| 19 | 50 | | 1.2 | 12 | (4.3 zinc iodide) | 3800 | 47 | 119 | 1.5 |
| 20 | 50 | | 1.2 | 12 | (3.2 iron iodide) | 3600 | 67 | 107 | 1.5 |
| 21 | 50 | | 1.2 | 12 | (6.4 iron iodide) | 2800 | 52 | 115 | 1.5 |

We claim:

1. A high-intensity-discharge lamp which efficiently illuminates objects with excellent color appearance, said lamp comprising:

a sealed light-transmitting arc tube of predetermined dimensions and enclosing a predetermined volume;

electrodes operatively disposed within said arc tube and spaced from one another a predetermined distance to define therebetween an arc path of predetermined length, lead-in conductors sealed through said arc tube and electrically connecting to said electrodes;

a light-transmitting protective envelope surrounding said arc tube and enclosing a predetermined environment, conductor means sealed through said protective envelope, and means electrically connecting said conductor means to said lead-in conductors;

said arc tube enclosing a small charge of inert ionizable starting gas and a discharge-sustaining filling substantially comprising:

mercury in predetermined amount as required to provide a predetermined voltage drop between said electrodes when said lamp is normally operating;

thallous iodide in amount to provide from about 0.02 mg to about 0.2 mg of TlI per cc of volume enclosed by said arc tube;

stannous iodide in amount to provide from about 0.1 mg to about 0.8 mg of $SnI_2$ per cc of volume enclosed by said arc tube;

calcium iodide in amount to provide from about 0.25 mg to about 2.5 mg of $CaI_2$ per cc of volume enclosed by said arc tube and to provide from about 1.2 mg to about 10 mg of $CaI_2$ per mg of said stannous iodide; and said lamp when normally operating having a predetermined power consumption, and means associated with said lamp causing the cold-spot temperature within said arc tube during normal lamp operation to be at least about 750° C.

2. The lamp as specified in claim 1, wherein said discharge-sustaining filling enclosed by said arc tube consists essentially of:

mercury in predetermined amount as required to provide a predetermined voltage drop between said electrodes when said lamp is normally operating;

thallous iodide in amount to provide from 0.04 to 0.14 mg of TlI per cc of volume enclosed by said arc tube;

stannous iodide in amount to provide from 0.2 to 0.6 mg of $SnI_2$ per cc of volume enclosed by said arc tube; and calcium iodide in amount to provide from 0.3 mg to 2 mg of $CaI_2$ per cc of volume enclosed by said arc tube and to provide from 1.4 mg to 8 mg of $CaI_2$ per cc mg of said stannous iodide.

3. The lamp as specified in claim 1, wherein said arc tube encloses a volume of about 11.5 cc, said thallous iodide is present in amount of about 1.2 mg, said stannous iodide is present in amount of about 4 mg, and said calcium iodide is present in amount of about 12 mg.

4. The lamp as specified in claim 1, wherein said arc tube encloses a volume of about 11.5 cc, said thallous iodide is present in amount of about 1.2 mg, said stannous iodide is present in amount of about 5 mg, and said calcium iodide is present in amount of about 16 mg.

5. The lamp as specified in claim 1, wherein said arc tube encloses a volume of about 3.6 cc, said thallous iodide is present in amount of about 1.2 mg, said stannous iodide is present in amount of about 2.6 mg, said calcium iodide is present in amount of about 4.2 mg, and additional iodine is introduced into said arc tube in the form of about 1 mg of $HgI_2$.

6. The lamp as specified in claim 1, wherein said arc tube encloses a volume of about 5.4 cc, said thallous iodide is present in amount of about 0.4 mg, said stannous iodide is present in amount of about 2.5 mg, and said calcium iodide is present in amount of about 5.2 mg, and additional iodine is introduced into said arc tube in the form of about 1 mg of $HgI_2$.

* * * * *